United States Patent [19]

Kennel

[11] Patent Number: 5,075,995

[45] Date of Patent: Dec. 31, 1991

[54] RECOIL REDISTRIBUTION GUNSTOCK

[76] Inventor: Gordon H. Kennel, 4402 NE. 104th Ave., Vancouver, Wash. 98662

[21] Appl. No.: 608,362

[22] Filed: Nov. 2, 1990

[51] Int. Cl.[5] ..... F41C 23/14

[52] U.S. Cl. ..... 42/73; 42/74

[58] Field of Search ..... 42/71.01, 73, 74

[56] References Cited

U.S. PATENT DOCUMENTS

| | | | |
|---|---|---|---|
| 219,969 | 2/1971 | Selnau | 42/71.01 |
| 220,691 | 5/1971 | Peterson | 42/71.01 |
| 717,011 | 12/1902 | Marsland et al. | 42/73 |
| 737,732 | 9/1903 | Gaut | 42/73 |
| 1,032,628 | 7/1912 | Sherman | 42/73 |
| 1,869,086 | 7/1932 | Ash | 42/73 |
| 2,100,514 | 11/1937 | Miller et al. | 42/73 |
| 2,432,519 | 12/1947 | Garand | 42/73 |
| 2,669,051 | 2/1954 | Cline | 42/73 |
| 3,710,496 | 1/1973 | Packmayr et al. | 42/73 |
| 4,027,416 | 6/1977 | Berbegal | 42/73 |
| 4,120,108 | 10/1978 | Vickers et al. | 42/74 |
| 4,296,566 | 10/1981 | Campos | 42/73 |
| 4,663,877 | 5/1987 | Bragg | 42/74 |
| 4,790,095 | 12/1988 | Campos | 42/73 |
| 4,896,446 | 1/1990 | Gregory | 42/73 |

*Primary Examiner*—Richard W. Wendtland

*Attorney, Agent, or Firm*—Jerry D. Guenther

[57] ABSTRACT

A gunstock which has a combination of elements including a contoured pistol handgrip portion, an adjustable face engaging means, and double longitudinal buttstock cast. The contoured pistol handgrip in combination with the adjustable face engaging means and longitudinal buttstock cast allow the user to most completely absorb the recoil of the rifle as well as allow uniform positioning of the rifle for sighting.

2 Claims, 3 Drawing Sheets

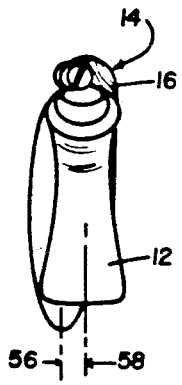
FIG. 5
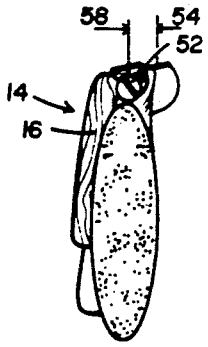
FIG. 6
FIG. 7
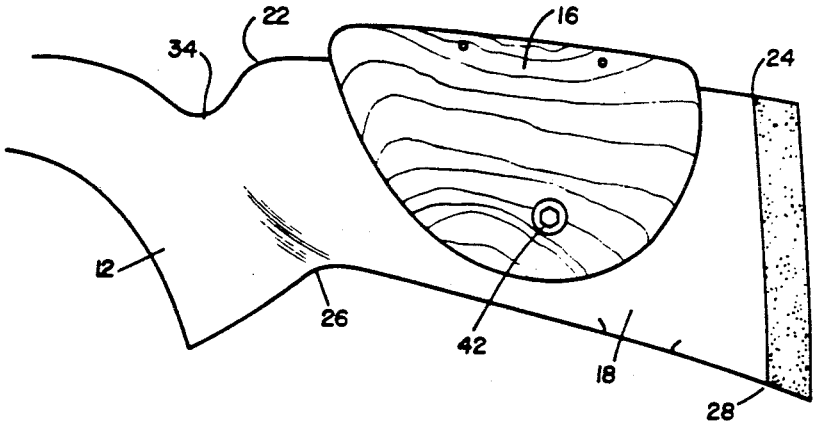
FIG. 8
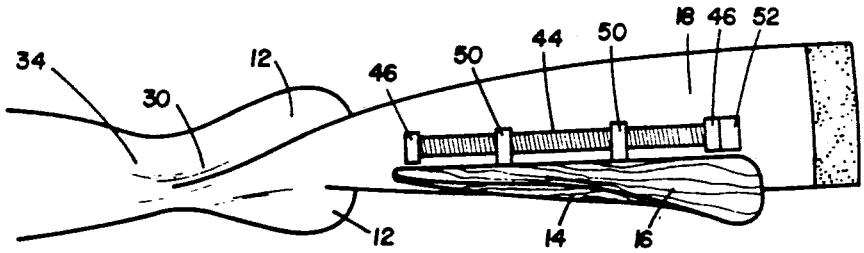
FIG. 9
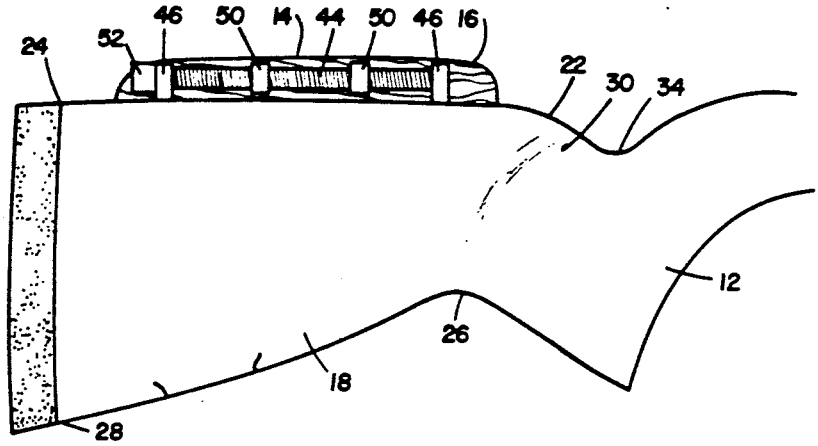

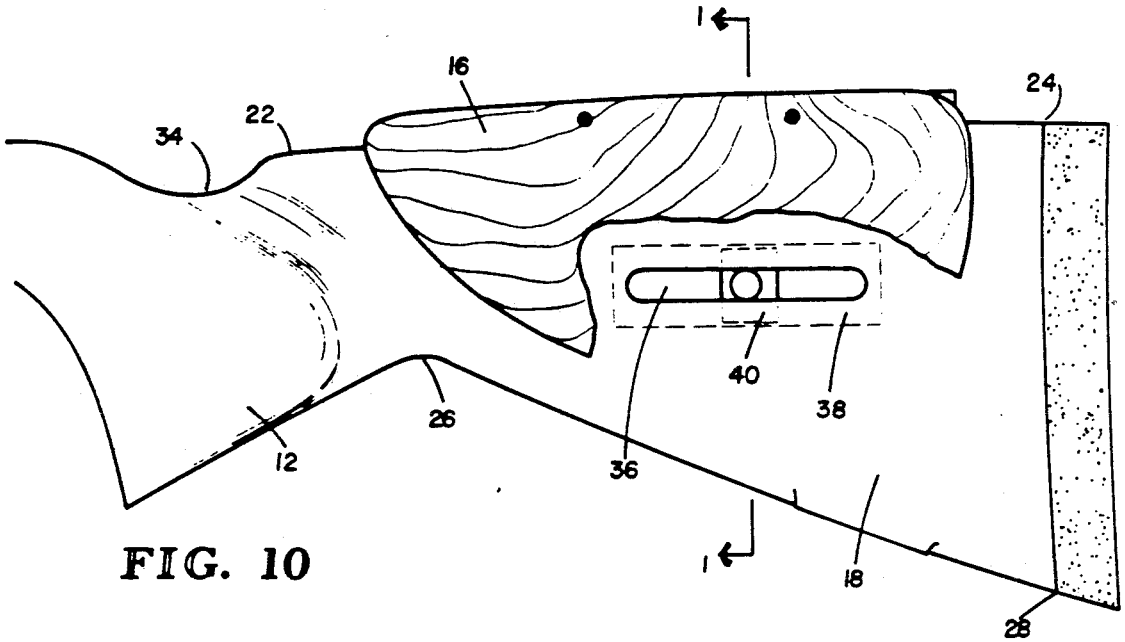
FIG. 10
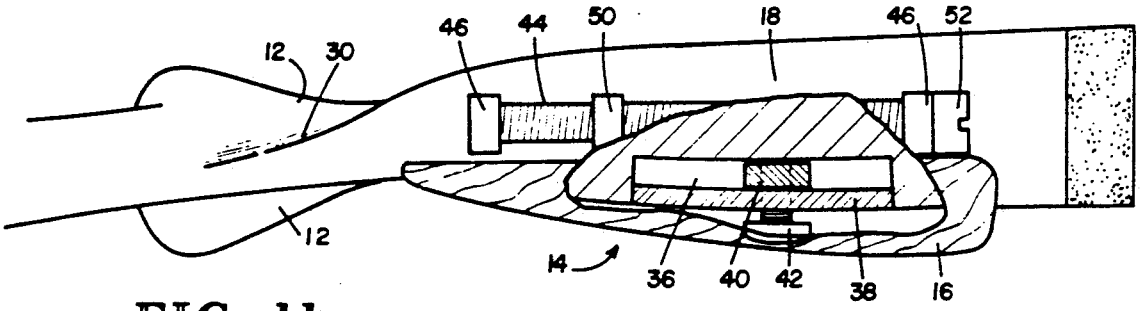
FIG. 11
FIG. 12
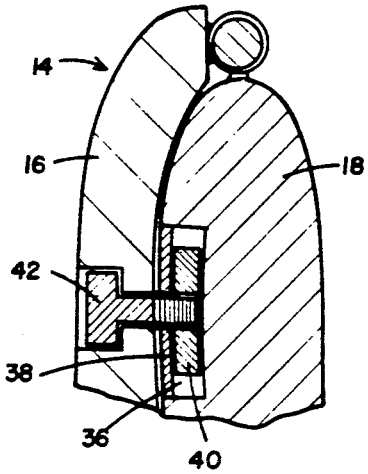

RECOIL REDISTRIBUTION GUNSTOCK

BACKGROUND OF THE INVENTION

While it is well known in the art to provide contoured pistol handgrips for rifle gunstocks, as exemplified by U.S. Pat. Nos. 4,296,566, and 4,790,095 to Conrad H. Campos, which use a sideways projecting portion for the pistol grip, a thumb receiving passage in the upper portion of the pistol grip, and contouring for nested engagement with the palm of the trigger hand and finger grip engagement; and while it is well known in the art to provide buttstock face engaging means, as exemplified by U.S. Pat. No. Des. 220,691 to Charles R. Peterson; and U.S. Pat. No. 4,120,108 to Charles K. Vickers and Patricia A. Vickers; and while it is well known in the art to provide buttstock adjustable face engaging means, as exemplified by U.S. Pat. Nos. 3,710,496 to Frank A. Packmayr, et al.; 2,669,051 to J. Cline; 2,100,514 to E. E. Miller, et al.; 1,032,628 to Perry B. Sherman; and 737,732 to Joseph Gaut, and while it is well known in the art to provide for longitudinal cast in a buttstock as exemplified by U.S. Pat. Nos. 1,869,086 to C. S. Ash; and 4,027,416 to Jose Luis Alfonso Berbegal, it has been found that a gunstock combining a contoured pistol handgrip with a buttstock containing an adjustable face engaging means and differential longitudinal cast of both upper and lower ridges of the buttstock from the pistol handgrip to the butt will allow for reduction of recoil impact to the user's shoulder upon firing as well as uniform positioning of the firearm for sighting.

The surface of a conventional firearm buttstock is generally not configured for the user's hand to retain maximum grip on the buttstock to upon firing. The upper portion of a conventional buttstock is sized and contoured for an average user, and typically no provision is made for differences among prospective users so that an individual user's sighting adjustment must be made each time in positioning the firearm to achieve both comfort and target alignment of the sights.

The present invention constitutes an improvement over previous firearm gunstocks and provides an improved gunstock for the user. The combination in a buttstock of a contoured pistol handgrip, adjustable face engaging means, and longitudinal cast of both upper and lower ridges of the buttstock from the pistol handgrip to the butt provide maximum grip for absorption of recoil upon firing as well as uniform positioning of the firearm for sighting.

SUMMARY OF THE INVENTION

It is a major objective of my invention to provide for the redistribution of recoil as well as accurate uniform positioning of a firearm by a user while in the firing position, generally by provision of a firearm gunstock buttstock combining an adjustable face engaging means, a contoured pistol handgrip and longitudinal cast of both upper and lower ridges of the buttstock from the pistol handgrip to the butt, so that upon individualized adjustment thereof, the firearm is uniformly positioned for sighting merely upon being brought to the firing position.

Specifically, my invention provides a firearm gunstock supporting a firearm mechanism and firearm barrel and providing for a buttstock having in combination a hand nesting contoured pistol handgrip portion, an adjustable face engaging means and longitudinal cast of both upper and lower ridges of the buttstock from the pistol handgrip to the butt. The contoured pistol handgrip includes downward contourment for engagement with three fingers of a user's hand and, a thumb engagement upper surface for either nesting a user's thumb or placing a user's thumb over the upper ridge of the buttstock and placing a user's forefinger in proximity with the firearm trigger. The adjustable face engaging means includes a moveable cheek piece carried on the side and upper ridge of the buttstock, and adjustable to variably accommodate the user in firing position. The cheek piece of the adjustable face engaging means is mounted to have longitudinal front and rear adjustable movement in relation to the buttstock. The longitudinal cast of the upper ridge, comb to heel, of the buttstock from pistol handgrip to butt having between 1.5 to 7.0 elements of degree of angle from a longitudinal axis of the firearm barrel. The longitudinal cast of the lower ridge, pistol grip to toe, of the buttstock from pistol grip to butt having between 3.5 to 11.0 elements of degree of angle from a longitudinal axis of the firearm barrel. With the combination of cast and adjustment of the face engaging means, the user's sighting eye will be uniformly positioned when the firearm is in the firing position.

BRIEF DESCRIPTION OF THE DRAWINGS

FIG. 5 is a front plan view of the present invention;

FIG. 6 is a back plan view of the present invention;

FIG. 7 is an enlarged fragmentary detailed side elevational view of one side of the buttstock of the present invention;

FIG. 8 is an enlarged fragmentary detailed top elevational view of the top of that part of the buttstock shown in FIG. 7;

FIG. 9 is an enlarged fragmentary side elevational view of the side opposite to that part of the buttstock shown in FIG. 7;

FIG. 10 is an enlarged fragmentary side elevational view of the side of the buttstock shown in FIG. 7, with a portion of the adjustable face engaging means cheek piece broken away and the buttstock sidewall recess, slotted guide frame and threaded nut illustrated;

FIG. 11 is an enlarged fragmentary top elevational view of the top of the buttstock shown in FIG. 7, with a portion broken away and shown in cross-section to better illustrate the construction thereof;

FIG. 12 is a transverse cross sectional view on line 1—1 of FIG. 10.

DETAILED DESCRIPTION OF THE INVENTION

Figure 1:
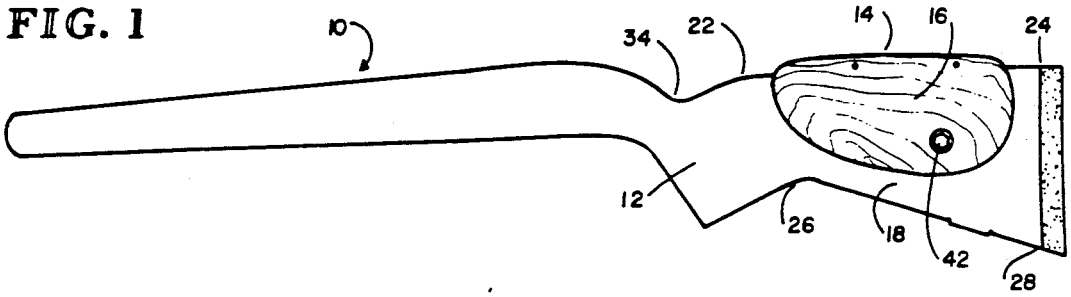
FIG. 1 is a left side plan view of the present invention.
Figure 2:
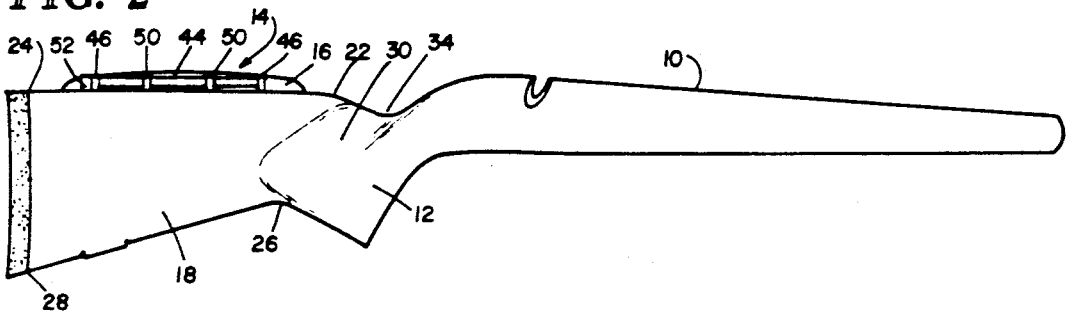
FIG. 2 is a right side plan view of the present invention.

Referring now more particularly to the drawings, the gunstock is generally indicated at 10, comprising in combination, a buttstock 18 with a contoured pistol handgrip 12, an adjustable face engaging means 14 with a cheek piece 16, a longitudinal cast 54 from comb 22 to heel 24, and a longitudinal cast 56 from attachment of said buttstock at the bottom of said pistol grip 26 to toe 28.

Figure 3:
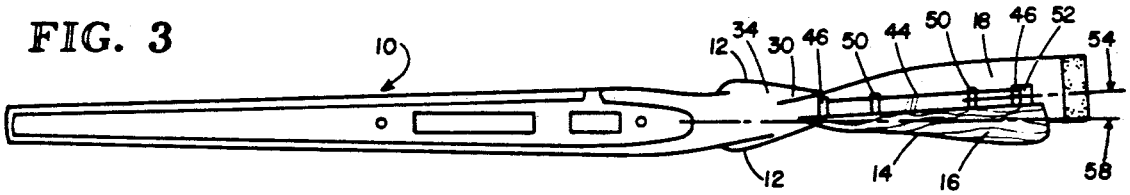
FIG. 3 is a top plan view of the present invention.

Referring now more particularly to Figures I, 2, 3, 7, 8, 9, 10, and 11 and with particular reference being made to the improved configuration of the buttstock 18, a pistol handgrip 12 is downwardly contoured for nesting with the palm of a users hand at 30 (FIGS. 2, 3, 8, and 11), and a thumb engagement upper surface is undercut for placing a user's thumb at 34 (FIGS. 1, 2, 3, 7, 8, 9 and 10). As shown in FIGS. 3, 8 and 11, the contoured pistol handgrip 12 allows a firearm user to position his forefinger in proximity with the trigger and have his thumb on the surface such that the pistol handgrip is securely nested within the palm of the user's hand.

It will be understood from the above that the described contour features incorporated in the buttstock 18, provide a user with greater controlled securement and positionment of the buttstock, in turn providing greater accuracy and elimination of recoil impact.

Referring to the cheek piece 16 of the adjustable face engaging means 14 attached to the buttstock 18, it will be understood that the cheek piece broadly comprises a wood structure, metal stamping, casting or molding of a suitably rigid plastic material such as styrene polymer, rubber modified styrene polymer or acrylonitrilebutadiene-styrene polymer, or other synthetic organic polymer, thermoplastic or thermosetting, which can be molded or formed into a contoured wall having a suitable thickness, e.g. varying from one-sixteenth inch to one-half inch in various sections and adapted to be securely attached to the buttstock and engaged against a user's face without distortion.

As shown in FIGS. 10, 11 and 12, the buttstock 18 is cut to provide for a longitudinally extending sidewall recess at 36. Disposed within the longitudinally extending sidewall recess 36 is a slotted guide frame at 38. Disposed between the slotted guide frame 38 and the buttstock 18 within the longitudinally extending sidewall recess 36 is a threaded nut 40 which is free to slide longitudinally along the length of the longitudinally extending sidewall recess 36.

As shown in FIGS. 1, 7, 11 and 12, disposed within the cheek piece 16 of the adjustable face engaging means 14 is a threaded bolt 42 which is countersunk into and extends through the cheek piece 16 and the slot in the slotted guide frame 38 and engages the threaded nut 40 in the longitudinally extending sidewall recess 36, enabling securement of the cheek piece 16 to the side of the buttstock 18 in a longitudinally adjusted manner. The threaded bolt 42 is disposed in the cheek piece 16 such that the outer surface of the bolt is flush with the outer surface of the cheek piece when the bolt is disposed in place in the cheek piece.

As shown in FIGS. 2, 3, 6, 7, 8, 9, 11 and 12, an adjustable face engaging means 14 is attached to the buttstock 18. The adjustable face engaging means 14 consists of a cheek piece 16 and means for attaching and adjusting the cheek piece longitudinally on the buttstock. The means for attaching and adjust to the cheek piece longitudinally on the buttstock consists of a threaded rod 44 attached to the buttstock 18 parallel to the longitudinal upper ridge of the buttstock between the comb 22 and heel 24 of the buttstock. The threaded rod 44 is attached to the buttstock by bushings 46 on each end of the threaded rod through which the threaded rod passes and is secured, and within which the threaded rod is free to rotate, said bushings being anchored to the buttstock. Attached to the cheek piece 16 in proximity with the upper ridge of buttstock 18 when the cheek piece is properly positioned on the buttstock are threaded nuts 50 mounted in longitudinal spacial alignment which complement sizewise and are threaded onto the threaded rod 44. The threaded nuts 50 are anchored securely to the cheek piece 16 such that when they are threaded onto the threaded rod and the threaded rod 44 is disposed within the bushings 46 attached to the buttstock 18 and rotated, the cheek piece 16 adjusts longitudinally in relation to the buttstock 18. Mounted on the end of the threaded rod 44 in proximity to the heel 24 of the buttstock 18 is a bolt head 52 for rotation of the threaded rod. Rotation of the bolt head 52 and thus the threaded rod 44 moves the threaded nuts 50 which are longitudinally spatially aligned and thus the cheek piece 16 forward or backwarded in longitudinal relation to the buttstock 18.

Figure 4:
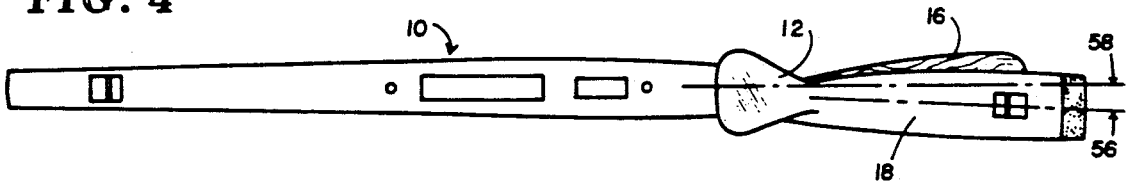
FIG. 4 is a bottom plan view of the present invention.

As shown in FIGS. 3, 4, and 6 the upper ridge of the buttstock 18 has longitudinal cast 54 from comb 22 to heel 24 and the lower ridge of the buttstock 18 has longitudinal cast 56 from attachment of the buttstock at the bottom of the pistol hand grip 26 to toe 28. Upper ridge longitudinal cast 54 and lower ridge longitudinal cast 56 are elements of degrees of angle in relation to a longitudinal axis along the lie of a barrel of the rifle and extending rearwardly in the direction of the buttstock to point beyond the heel or toe of the buttstock. The longitudinal cast 54 from comb 22 to heel 24 is generally an element of 3.5 degrees of angle but can vary from 1.5 to 7.0 elements of degree of angle. The longitudinal cast 56 from attachment of the buttstock at the bottom of the pistol handgrip 26 to toe 28 is generally an element of 7.0 degrees of angle but can vary from 3.5 to 11.0 elements of degree of angle. While preferred embodiments of the combination of the invention have been herein shown and described, obviously changes in details can be effected without departing from the spirit and scope of the invention as defined in, and limited solely by, the appended claims.

What is claimed is:

1. A gunstock for supporting a gun mechanism and a gun barrel, said gunstock comprising, in combination:

a buttstock having a comb, a heel, a butt, a toe, a pistol hand grip and an adjustable face engaging means;

said pistol handgrip being downwardly contoured for nesting engagement with the palm of a user's hand;

said buttstock including an integral portion disposed behind and downwardly contoured along said pistol handgrip, said integral portion disposed behind and downwardly contoured along said pistol handgrip having a thumb engagement upper surface for nesting engagement with a user's thumb, said thumb engagement upper surface being disposed such that a user may position a forefinger on said pistol handgrip lower surface and a thumb on said thumb engagement upper surface, with said pistol hand grip portion nested with the palm of the user's hand; and said adjustable face engaging means carried on a side and upper ridge of said buttstock between the comb and the heel, structure mounting said adjustable face engaging means on said buttstock in adjustable spaced relation for variable accomodation of the buttstock in firing position, said mounting structure including a plurality of distributed spacer elements supporting said face engaging means in adjustable spaced relation to the upper ridge of said buttstock between the comb and the heel, said spacer elements including a plurality of threaded nuts secured to said face engaging means in spatial relation to the upper ridge of said buttstock between the comb and heel said adjustable face engaging means having a threaded bolt disposed parallel to and above the upper ridge of said buttstock between the comb and heel for adjustment of said spacer elements a means for securing and attaching said threaded bolt to the top of said buttstock between the comb and heel said threaded bolt having a head for rotating said threaded bolt within said means for attaching said threaded bolt said plurality of distributed spacer elements supporting said face engaging means threaded onto said threaded bolt said face engaging means having a check piece; and said buttstock having a sidewall recess extending longitudinally, said sidewall recess in proximity with said adjustable face engaging means, said sidewall recess having a slotted guide frame, said sidewall recess having a threaded nut retained within said sidewall recess by said slotted guide frame said adjustable face engaging means having a threaded bolt disposed within said cheek piece for engagement with said threaded nut retained within said sidewall recess for attaching said face engaging means to said buttstock; and said buttstock having a longitudinal cast from comb to heel, said longitudinal cast from comb to heel having 1.5 to 7.0 elements of degrees of angle from a longitudinal axis of said barrel; and said buttstock having a longitudinal cast from the attachment of said buttstock at the bottom of said pistol handgrip to toe, said longitudinal cast from said pistol handgrip to toe having 3.5 to 11.0 elements of degrees of angle from of the longitudinal axis of said barrel.

2. A gunstock as defined in claim 1 further comprising said longitudinal cast from comb to heel having 3.5 elements of degree of angle from a longitudinal axis of said barrel and said longitudinal cast from the attachment of said buttstock at the bottom of said pistol grip to the toe having 7.0 elements of degree of angle from a longitudinal axis of said barrel.

* * * * *